US005532706A

United States Patent [19]

Reinhardt et al.

[11] Patent Number: 5,532,706

[45] Date of Patent: Jul. 2, 1996

[54] ANTENNA ARRAY OF RADIATORS WITH PLURAL ORTHOGONAL PORTS

[75] Inventors: Victor S. Reinhardt, Rancho Palos Verdes; Steven O. Lane, Torrance, both of Calif.

[73] Assignee: Hughes Electronics, Los Angeles, Calif.

[21] Appl. No.: 349,637

[22] Filed: Dec. 5, 1994

[51] Int. Cl.[6] ..... H01Q 13/00

[52] U.S. Cl. ..... 343/778; 343/853; 333/21 A

[58] Field of Search ..... 343/778, 786, 343/754, 853; 333/21 A, 21 R

[56] References Cited

U.S. PATENT DOCUMENTS

| | | | |
|---|---|---|---|
| 3,868,695 | 2/1975 | Kadak | 343/778 |
| 3,922,680 | 11/1975 | Alsberg et al. | 343/778 |
| 4,414,550 | 11/1983 | Tresselt | 343/700 MS |
| 4,939,527 | 7/1990 | Lamberty et al. | 343/778 |
| 4,962,383 | 10/1990 | Tresselt | 343/700 MS |
| 5,214,394 | 5/1993 | Wong | 343/700 MS |
| 5,304,999 | 4/1994 | Roberts et al. | 343/778 |

*Primary Examiner*—Donald T. Hajec
*Assistant Examiner*—Tan Ho
*Attorney, Agent, or Firm*—Terje Gudmestad; W. K. Denson-Low

[57] ABSTRACT

A phased array antenna (10A, 10B, 10C) is constructed of an array of radiators (24), each of which has a radiating aperture, a first port (26) and a second port (26). The first port introduces a first radiation with a first polarization, and the second port introduces a second radiation with a second polarization which is orthogonal to the first polarization. Individual transmitting amplifiers, in the case of a transmitting array, or individual receiving amplifiers (16A), in the case of a receiving array, are connected to the ports of each of the radiators. The amplifiers associated with the first ports of the respective radiators are connected, in turn, to phase shifters (18A) and attenuators (20A) which constitute a first beamformer for forming a set of one or more beams of radiation. The amplifiers (16A) associated with the second ports of the respective radiators are connected, in turn, to phase shifters (18A) and attenuators (20A) which constitute a second beamformer for forming a set of one or more beams of radiation. The two beamformers operate independently of each other so as to permit separately weighted polarization signals of the antenna to be programmed electronically for various polarizations such as right and left circular polarization or horizontal and vertical polarization. Also, the separately polarized waves associated with the first ports and the second ports permit dual polarization frequency reuse transmission.

2 Claims, 4 Drawing Sheets

ANTENNA ARRAY OF RADIATORS WITH PLURAL ORTHOGONAL PORTS

BACKGROUND OF THE INVENTION

This invention relates to a phased array antenna and, more particularly, to a phased array antenna composed of radiators having plural ports for introduction of orthogonally polarized radiation to individual ones of the radiators.

Phased array antennas are widely used for directing one or more beams of radiation in desired directions for transmission of radiant energy and for reception of radiant energy. Such antennas are used, by way of example, in satellite communication systems and in aircraft guidance systems. The antennas are useful because beam steering and beam pattern reconfiguration can be performed electronically, and without moving parts. In a typical phased array antenna, there are a plurality of radiators, each of which serves as an element of the antenna. It has been the practice to construct each radiator with a single port coupled electromagnetically to a signal means, wherein the signal means is a transmitting amplifier in the case of an antenna which transmits a beam of radiation, the signal means being a receiving amplifier in the case of an antenna which receives an incoming electromagnetic signal. The operation of a phased array antenna in the transmission mode is essentially the same as the operation in a receiving mode except that the direction of signal flow is reversed between the two modes.

By way of example, in the case of the receiving mode, a plurality of the radiators receives radiated signals with a specified polarization from a wide range of far field angles. The signal received at the individual radiators are then amplified, phase shifted, attenuated, and summed to produce a final antenna output. The phased array antenna can produce a narrow beam by virtue of the fact that only signals in a desired far field direction will add up in phase to produce a large output signal. A pointing of the beam is accomplished by adjustment of the phase shifters to cancel increments of phase shift experienced by successive ones of the radiators of the array from an incoming signal wavefront angled relative to the array of radiators. The attenuators are utilized to shape the beam pattern, as well as for calibration purposes. Multiple beams can be generated from the same radiating aperture of the antenna by adding more phase shifters and attenuators for each antenna element, or radiator, to produce several summed outputs.

A problem arises with presently available phased array antennas in that there is only one output port, or input port, provided for each antenna element. Therefore, the polarization properties of the phased array antenna are determined by the polarization properties of the individual antenna elements. This produces a disadvantage in that the polarization properties of the antenna cannot be programmed spatially otherwise. A further disadvantage is that the polarization orthogonality properties are determined by imperfections which may be present in the individual radiators, a disadvantage which is particularly significant for a wide field of view. Due to the fact that the polarization property of the antenna depends on the design of the individual radiators, such antennas have suffered from the limitation that only one polarization can be obtained over a complete field of view for each beam, and a further limitation that it is difficult to maintain good polarization orthogonality properties over a large field of view.

SUMMARY OF THE INVENTION

The aforementioned problem is overcome and other advantages are provided by a phased array antenna constructed of an array of radiators each of which has a radiating aperture. In accordance with the invention, each of the radiators has a first port and a second port electromagnetically coupled to the radiating aperture and wherein the first port introduces a first radiation with a first polarization and the second port introduces a second radiation with a second polarization orthogonal to the first polarization. First signal means are connected to the first ports of each of the radiators, the first signal means constituting a transmitting amplifier in the case of a transmitting array, and a receiving amplifier in the case of a receiving array. In similar fashion, a second signal means is coupled to individual ones of the second ports of the respective radiators. The signal means, in turn, connect with phase shifters and attenuators which constitute beamformers for providing a set of one or more beams associated with the first ports and a set of one or more beams associated with the second ports of the radiators. The signal means and associated beamformer connected to the first ports of the respective radiators operate independently of the signal means and beamformer associated with the second ports of the respective radiators. Thus, the polarized signals associated with the first ports can be phased and weighted separately from the phasing and weighting of the polarized signals associated with the second ports.

The separately weighted polarization signals allow the polarization to be programmed electronically for any polarization such as right and left circular or horizontal and vertical polarization. Orthogonality of polarization can be maintained accurately over a wide field of view regardless of imperfections which may be present in the individual radiators and their ports by use of suitably compensating weighting of the signals of the first and the second ports of the respective radiators. The multiple lobe beam can also be generated with different polarizations in each direction. Furthermore, the invention makes is feasible to develop a wide field of view phased array antenna for dual polarization frequency reuse transmission because of the high degree of polarization orthogonality that can be achieved. This can be accomplished by providing two separate beam inputs or beam outputs, each with its own separate weighting circuits.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element in the different figures.

DETAILED DESCRIPTION

Figure 1:
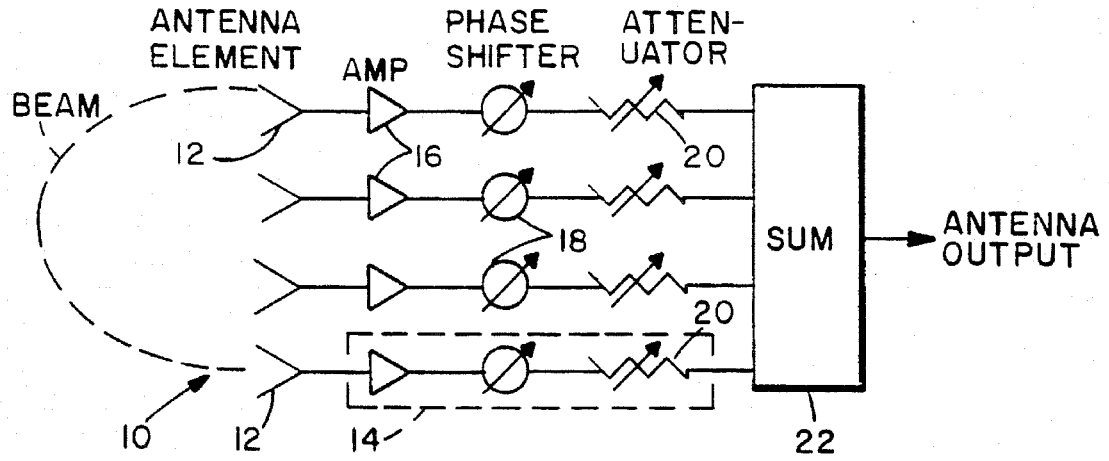
FIG. 1 PRIOR ART
FIG. 1 shows a generalized diagram of a phased array antenna of the prior art wherein radiators are provided with only a single port.

FIG. 1 shows a typical receive phased array antenna 10 of the prior art. The elements of the antenna 10 comprise an array of radiators 12 arranged for receiving an incoming beam of electromagnetic radiation. The signals received by respective ones of the radiators 12 are processed by signal processing channels 14 wherein each of the channels 14 comprises an amplifier 16, a phase shifter 18 and an attenuator 20. In each of the channels 14, a signal received by the corresponding radiator 12 is amplified by the amplifier 16, receives a phase shift by the phase shifter 18 and receives an amount of attenuation provided by the attenuator 20. The signal outputted by the attenuator 20 constitutes an output signal of the signal processing channel 14. Output signals of the channels 14 are summed by a summer 22 to provide an output signal representing the summation of the contributions to an incoming beam of radiation as received by the radiator 12.

In the antenna 10, the several radiators 12 receive radiated signals with a certain polarization from a wide range of far field angles. The contribution of the phase shifts of the various phase shifters 18 provides for a cophasal summation of the incoming signal components of the respective radiators from a specific direction, and the attenuations provided by the attenuators 20 constitute an amplitude taper of the incoming beam. A narrow beam can be provided because only signal contributions from a signal source in a specific direction can add up in phase to produce the large output signal. Pointing the beam is accomplished by adjusting the phase shifters to compensate for a phase taper across the array of radiators introduced by an off boresight direction of the incoming radiation. An antenna for transmission of radiation is constructed in the same general form as the antenna 10, but the amplifiers 16 would be replaced with high powered transmitting amplifiers with output signals of the amplifiers being directed to the radiators 12, and with input signals being applied via the attenuator and the phase shifter to the amplifier. Also, the summer 22 would be replaced with a power divider receiving a signal from a signal source.

Figure 2:
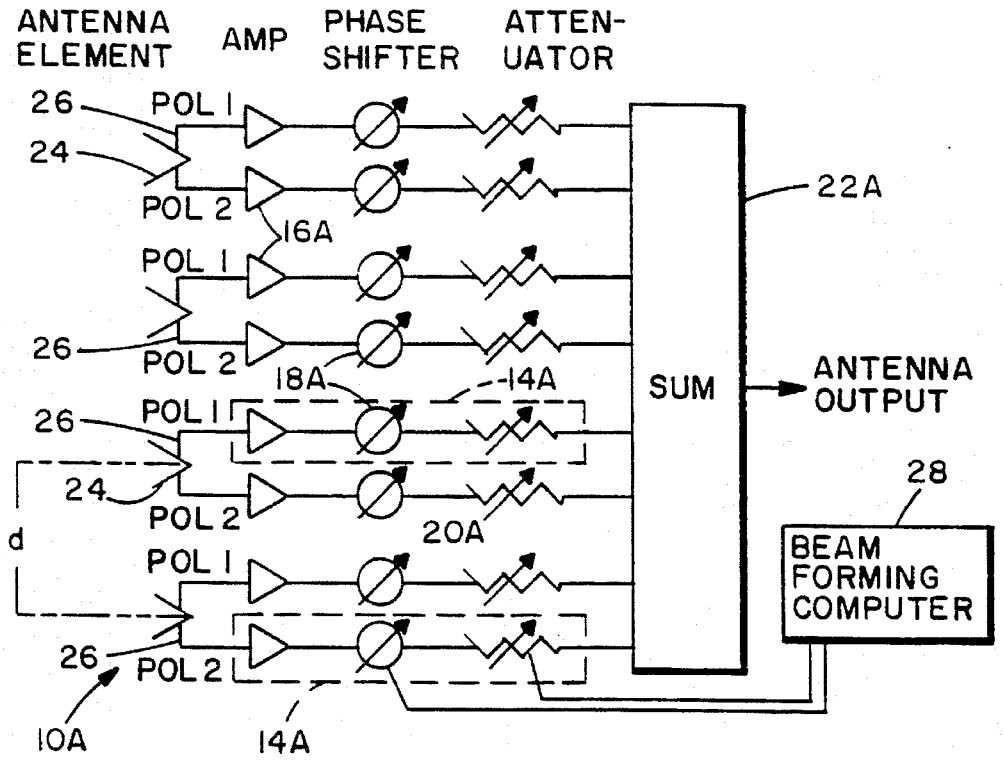
FIG. 2 shows a first embodiment of a phased array antenna in accordance with invention wherein each of the radiators is provided with two ports.

FIG. 2 shows a phased array antenna 10A constructed in accordance with the invention and having an array of radiators 24 arranged for forming a beam of radiation. By way of example in the explanation of the invention, the antenna 10A is depicted as a receiving antenna. However, it is to be understood that the principles of the invention apply equally well to a transmitting antenna. Each of the radiators 24 is provided with two ports 26 providing nominally orthogonal polarizations to radiation transmitted by the radiator 24 in the case of a transmitting antenna, and being adapted to receive orthogonally polarized waves in the case of a receiving antenna. In each of the radiators 24, the port 26 which produces a first of the two polarization is identified in the figure as Pol 1, and the port 26 producing the second of the polarizations is identified in the figure as Pol 2. Each of the ports 26 is connected by a signal processing channel 14A to an input port of a summer 22A. Each of the channels 14A comprises an amplifier 16A, a phase shifter 18A, an attenuator 20A. The amplifier 16A serves to amplify the incoming signal and to filter the incoming signal so as to raise the signal-to-noise power ratio. The phase shifters 18A provide the requisite phase shifts to compensate for phase shifts introduced by an inclination of a waveform to the plane of the array of radiators 24, thereby to provide for a cophasal combination of the signal contributions of each of the radiators 24. The attenuators 20A provide for an amplitude taper to configure the shape of the incoming beam. Individual ones of the phase shifters 18A and individual ones of the attenuators 20A may be controlled electronically, as is well known, by a beam forming computer 28. The computer 28 is to be employed in other embodiments of the invention as will be disclosed in FIGS. 4 and 5, but has been deleted in those figures to simplify the drawing.

The polarization produced by the ports 26 may be right and left circular, by way of example, or horizontal and vertical. The antenna 10A is operative in accordance with the invention even if the polarizations at the two ports of a radiator are not perfectly orthogonal. By combining the two polarized signals at each of the radiators 24 with various phase shifts and attenuations, any desired polarization can be obtained in any direction. Compensation can be made for imperfections in any one of the radiators 24 if the polarization properties of each of the radiators 24 is known as a function of beam pointing direction, and wherein the two polarizations Pol 1 and Pol 2 are linearly independent.

Figure 3:
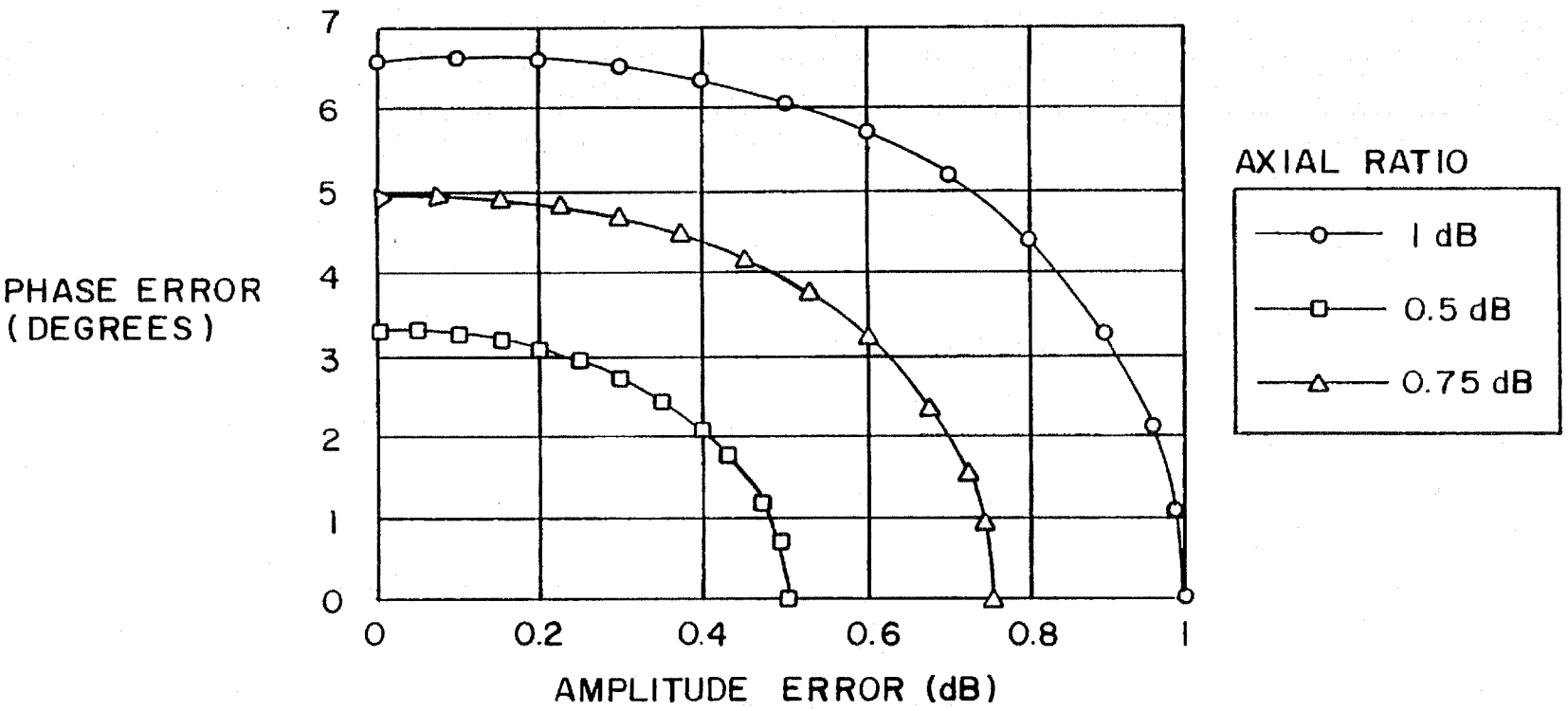
FIG. 3 is a graph showing operational characteristics of an antenna constructed in accordance with the invention.

The graph of FIG. 3 shows the phase and amplitude error requirements to achieve the various axial ratios for circular polarizations. Herein, it is presumed that the spacing, d, between the radiators 24 of FIG. 2, as measured between center lines of the radiators 24, is less than or approximately equal to one-half wavelength of the radiation. The graph of FIG. 3 shows that the antenna 10A of FIG. 2 can achieve a 1 dB (decibel) axial ratio for the case wherein the phase shifters 18A are 5-bit digitally controlled phase shifters wherein one half of the least significant bit (LSB) error is 5.6°, and wherein the attenuators 20A are digitally controlled in steps of 0.5 dB. The graph of FIG. 3 applies also to the corresponding configuration of the antenna 10A wherein the antenna is constructed as a transmitting antenna.

Figure 4:
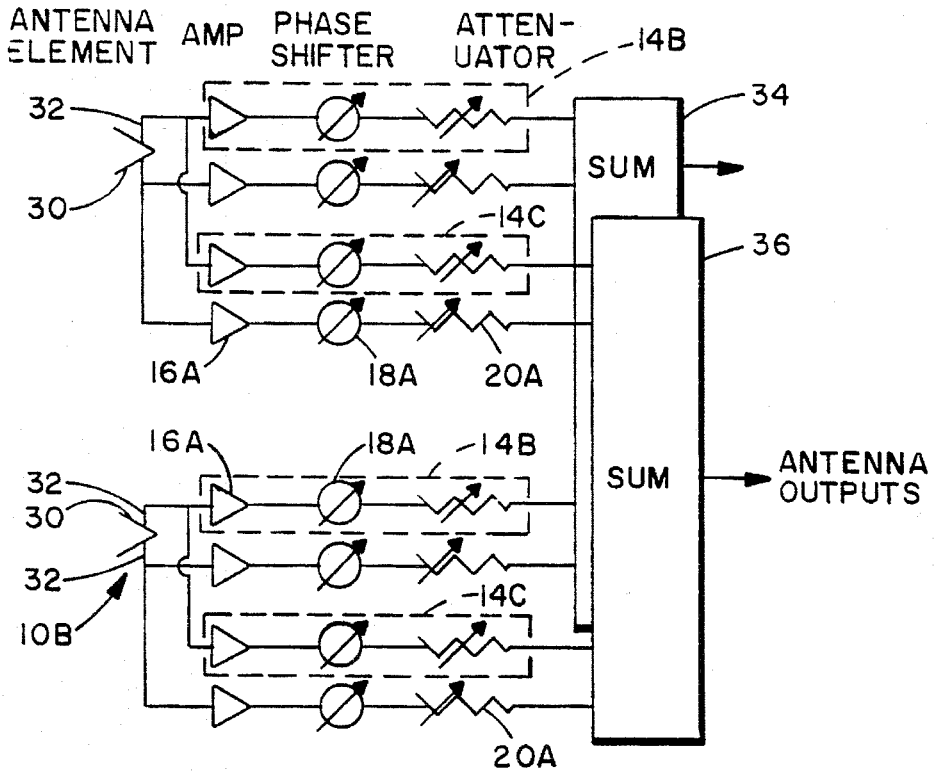
FIG. 4 shows a second embodiment of the phased array antenna of the invention for implementation of frequency reuse by circularly polarized waves.

In FIG. 4, a further embodiment of the invention is shown as the phased array antenna 10B which has an array of radiators 30 each of which is provided with a pair of ports 32. Each of the ports 32 is capable of coupling circularly polarized radiation of either hand. Each of the ports 32 applies a received signal to two signal processing channels 14B and 14C wherein the channel 14B processes signals having clockwise circular polarization and the channel 14C processes signals having counterclockwise circular polarization. The circularly polarized signals of the various channels 14B are summed by a summer 34, and the counter clockwise circularly polarized signals of the channels 14C are summed by a summer 36. Thus, there are two antenna outputs, namely, one output from the summer 34 and a second output from the summer 36. Each of the channels 14B and 14C comprise an amplifier 16A, a phase shifter 18A and an attenuator 20A, these components having been described previously with respect to FIG. 2. The antenna 10B of FIG. 4 makes feasible the developments of a wide field of view phased array antenna for frequency reuse transmission wherein there is simultaneous transmission of separate communications signals over two orthogonal polarizations. Phase shifting and attenuation can be controlled electronically as is shown in FIG. 2.

Figure 5:
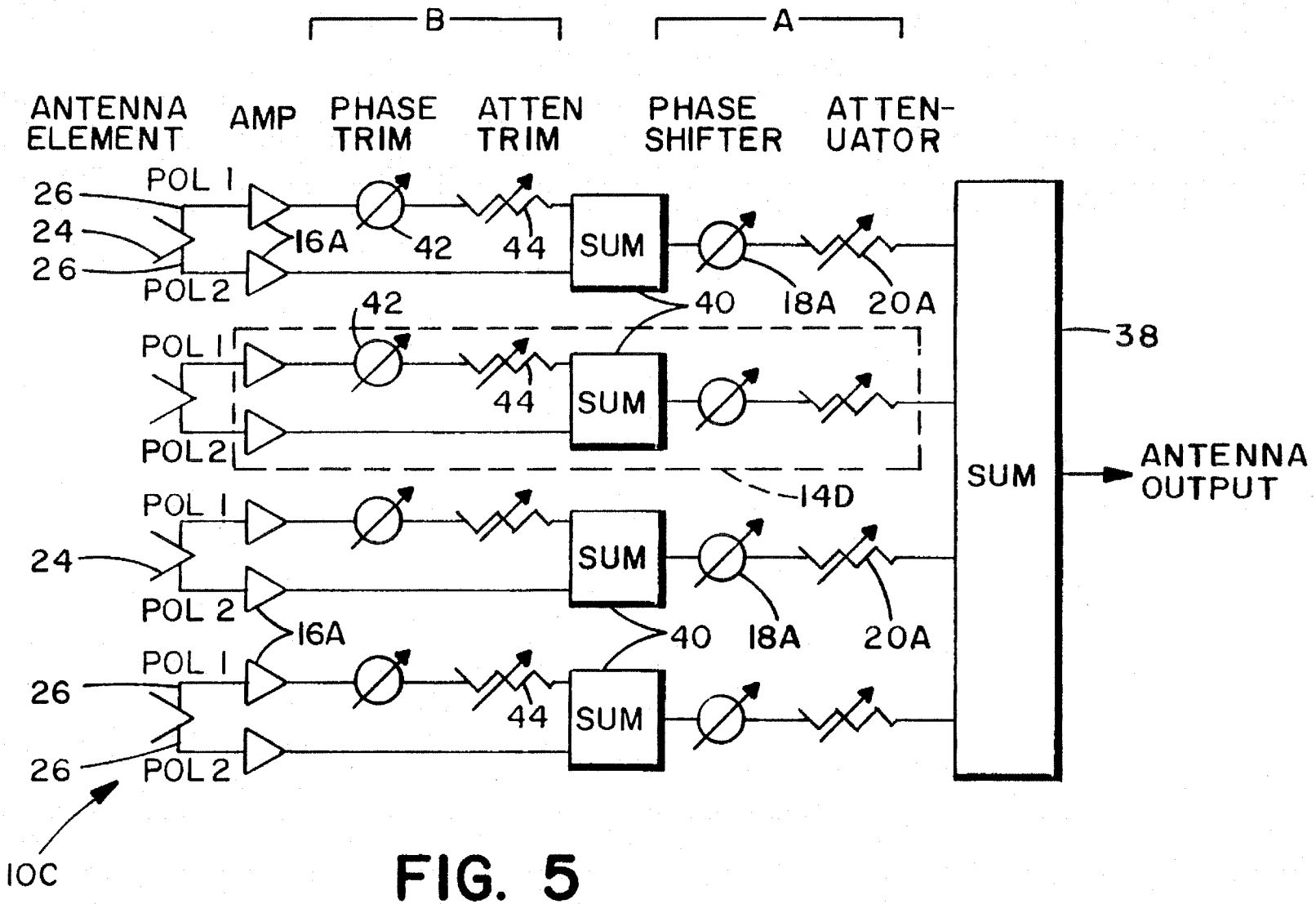
FIG. 5 shows a third embodiment of the phased array antenna of the invention employing radiators having two ports.

FIG. 5 shows a phased array antenna 10C which is yet a further embodiment of the invention. The antenna 10C comprises an array of the radiators 24 with their ports 26 as has been described above with reference to FIG. 2. In FIG. 5, the antenna 10C further comprises a plurality of signal processing channels 14D coupling the ports 26 of the respective radiators 24 to input terminals of a summer 38.

Each of the channels 14D is divided into sections, namely a section A, and a section B which are joined by a summer 40. Section A of the channel 14D comprises the phase shifter 18A and the attenuator 20A described previously with reference to the antenna of FIG. 2. Section B of each of the channels 14D comprises a phase shifter 42 and an attenuator 44. The phase shifters 42 are used to provide a trimming phase shift which is much smaller than the phase shift imparted by the phase shifter 18A. The attenuator 44 is employed to provide a trimming attenuation which is much smaller than the attenuation provided by the attenuator 20A. Section B is connected by amplifiers 16A to the two ports 26 of the respective ones of the radiators 24, the amplifiers 16A having been described above with reference to the antenna of FIG. 2.

In FIG. 5, channel 14D is bifurcated in the region of section B so as to provide for a direct connection from the amplifier 16A at the port Pol 2 to an input port of the summer 40 while, with respect to the amplifier 16A of the port Pol 1, a second branch of the channel 14D provides for connection of the amplifier 16A by the phase trimming phase shifter 42 and the attenuation trimming attenuator 44 to a further input port of the summer 40. Section A of each of the channels 14D provides the full amplitude and phase adjustment necessary for pointing the beam. Section B of each channel 14D provides necessary corrections to produce good polarization characteristics. An advantage of the configuration of the antenna 10C is that the phase shifters and attenuators of section B of the channels 14D can have a much simpler physical construction that the phase shifters and attenuators in section A of the channels 14D. For example, the set of B-section phase shifters need have only a phase range of 20–40 degrees, and the attenuators need have an amplitude range of 1–2 dB. Furthermore, the phase trimming phase shifters 42 and the amplitude trimming attenuators 44 need only a few bits of control to correct for any physical limitations of the radiators 24, the control bits being provided by a beam forming computer such as the computer 28 of FIG. 2.

Figure 6:
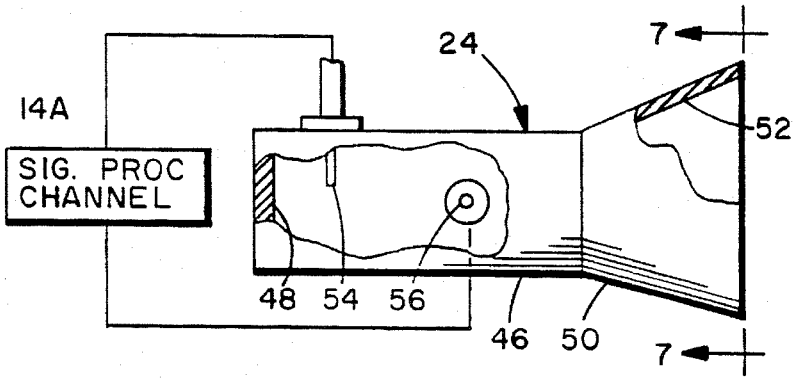
FIG. 6 presents an example of one embodiment of a radiator, shown in side elevation view, and having two ports for use in the antenna of the invention.
Figure 7:
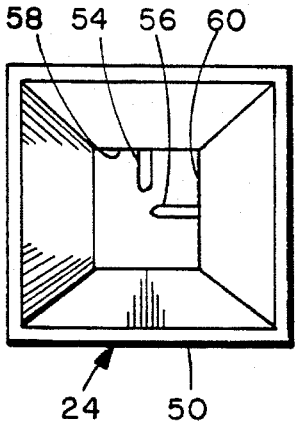
FIG. 7 is a front view of the radiator taken along the line 7—7 of FIG. 6.

FIGS. 6 and 7 show one embodiment of a radiator 24 which comprises a section of square waveguide 46 terminated at a back end by a back wall 48 and at a front end by a horn 50 which tapers outwardly from a front end of the waveguide 46 to provide for an enlarged radiating aperture. In FIG. 6, portions of the radiator 24 are cut away to facilitate a viewing of the back wall 48, a side wall 52 of the horn 50, and two probes 54 and 56 which are mounted to perpendicularly disposed sidewalls 58 and 60, respectively, of the waveguide 46. The probe 54 is located approximately one-quarter of the guide wavelength in front of the back wall 48, and the probe 56 is located approximately three-quarters of the guide wavelength in front of the back wall 48. The probes 54 and 56 each serve as one of the ports 26 for the antenna 10A of FIG. 2. Connection of the probes 54 and 56 to the signal processing channel 14A is indicated diagrammatically in FIG. 6. Other forms of construction of radiators as well as other forms of construction of coupling elements for coupling power into and out of the radiator may be employed to accommodate specific polarization requirements. Also, it is noted that in an antenna configuration such as that of FIG. 4 wherein two separate summers (the summers 34 and 36) are employed, the two ports to a radiator may be operated at different frequencies and, in such case, the physical configurations of the ports can be optimized for the specific frequencies.

A mathematical explanation of the theory of operation of the invention with respect to the various embodiments thereof is useful in understanding the operation of the invention, and is provided as follows.

Theory of Spatially Programmable Polarization Phased Array Consider the effect of having two polarization input ports on each element of a transmit phased array. If the polarization input port p of antenna element n is excited by a complex voltage $V(t)A_{np}$, a far field of the following form will be produced $$E_{np}(r)=V(t)A_{np}F_p(k)/r \tag{1}$$

where r is the distance vector from the antenna element, $A_{np}$ is the complex amplitude setting (both phase and scalar amplitude for the nth element and pth polarization port, $F_p(k)$ is proportional to the E-field directional patter of each element when port p is excited by $V(t)A_{np}$, and $$k=(\omega/c)r \tag{2}$$

The far electric field for the total array then becomes $$E(r)=V(t)\Sigma_{-p,n}\exp(-jk-x_n)A_{np}F_p(k)/r \tag{3}$$

where $\Sigma_{p,n}$ indicates the sum over the n elements and p polarizations, and where $x_n$ is the position of the nth element.

Letting $$A_{np}=\exp(jk_o-x_n)A_p \tag{4}$$

and assuming $F_p(k)$ doesn't change appreciably across the final beam, (3) becomes $$E(r)=V(t)\ (G(k-k_o)-x_n) \tag{5}$$

where the sinc-like array pattern function $G(k-k_o)$ is given by $$G(k-k_o)=\Sigma_n\exp(j(k_o-k)-x_n) \tag{6}$$

and where $$F'(k_o)=\Sigma_p A_p F_p(k_o) \tag{7}$$

Note that $A_p$ is again a complex amplitude containing both phase and scalar amplitude information. One can see from (7) that, by adjusting the $A_p$ values, one can obtain any arbitrary polarization for $F'(k_o)$ given the linear independence of the two vectors $F_p(k_o)$.

For a multiply lobed beam with amplitude weights $W_k$ at the directions k, one can set $$A_{np}=\Sigma_k W_k\exp(jk-x_n)\ A_p(k) \tag{8}$$

to produce lobes, each with different polarizations, as long as the pointing directions are more than a few beam widths from each other. For an arbitrary continuous weighting distribution, a least mean square solution can be found by minimizing a cost function.

The above discussion also holds for a receive array, since transmit patterns and receive gains are reciprocal.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A phased array antenna comprising:

a plurality of radiators arranged in an array, each of said radiators comprising a first port and a second port and a radiating aperture electromagnetically coupled to said first port and to said second port, said first port introducing a first radiation with a first polarization, said second port introducing a second radiation with a second polarization orthogonal to said first polarization;

first signal means having a first set of branches operatively coupling energy of said first radiation with the respective first ports of said radiators;

second signal means having a second set of branches operatively coupling energy of said second radiation with the respective second ports of said radiators, said second signal means being operative independently of said first signal means; and beamformer means coupled to said first and said second signal means for forming at least one beam of electromagnetic power from said array of radiators, wherein said beamformer means comprises a first beamformer coupled to the first ports of respective ones of said radiators and a second beamformer coupled to the second ports of respective ones of said radiators, said first beamformer providing a first set of beams and said second beamformer providing a second set of beams independently of said first set of beams, wherein each set of beams comprises at least one beam, and wherein each of said beamformers comprises a plurality of branches, an individual one of said branches is coupled via a respective one of said signal means to a port of an individual one of said radiators, each of said branches of respective ones of said beamformers is bifurcated into two signal carrying paths to enable operation of said antenna in a mode of frequency reuse, each of said paths of each of said branches having a phase shifter and an attentuator.

2. A phased array antenna comprising:

a plurality of radiators arranged in an array, each of said radiators comprising a first port and a second port and a radiating aperture electromagnetically coupled to said first port and to said second port, said first port introducing a first radiation with a first polarization, said second port introducing a second radiation with a second polarization orthogonal to said first polarization:

first signal means having a first set of branches operatively coupling energy of said first radiation with the respective first ports of said radiators:

second signal means having a second set of branches operatively coupling energy of said second radiation with the respective second ports of said radiators, said second signal means being operative independently of said first signal means; and beamformer means coupled to said first and said second signal means for forming at least one beam of electromagnetic power from said array of radiators, wherein said beamformer means comprises a first beamformer coupled to the first ports of respective ones of said radiators and a second beamformer coupled to the second ports of respective ones of said radiators, said first beamformer providing a first set of beams and said second beamformer providing a second set of beams independently of said first set of beams, wherein each set of beams comprises at least one beam, and wherein said beamformer means comprises a plurality of branches with one branch being connected to each of said radiators, each branch comprising a first branch section and a second branch section coupled to said first branch section, said first branch section having a phase shifter and an attenuator, said second branch section being bifurcated into two signal carrying paths connected to respective ones of said ports of an individual one of said radiators, one of said paths providing a direct connection between said signal means to said first branch section and a second of said paths having a phase shifter and an attenuator.

* * * * *